US006823879B2

(12) United States Patent
Fillipi et al.

(10) Patent No.: US 6,823,879 B2
(45) Date of Patent: Nov. 30, 2004

(54) APPARATUS FOR CLEANING PIPES

(75) Inventors: Gregory M. Fillipi, Norman, OK (US); Bobby E. Walls, Drumright, OK (US); Anthony K. Magerus, Nicoma Park, OK (US); Jerry L. Gore, Midwest City, OK (US)

(73) Assignee: Versar, Inc., Springfield, VA (US)

( * ) Notice: Subject to any disclaimer, the term of this patent is extended or adjusted under 35 U.S.C. 154(b) by 168 days.

(21) Appl. No.: 10/193,321

(22) Filed: Jul. 12, 2002

(65) Prior Publication Data

US 2002/0170582 A1 Nov. 21, 2002

Related U.S. Application Data

(62) Division of application No. 09/828,952, filed on Apr. 10, 2001, now Pat. No. 6,450,182.

(60) Provisional application No. 60/196,296, filed on Apr. 12, 2000.

(51) Int. Cl.[7] ..... B08B 9/02

(52) U.S. Cl. ..... 134/94.1; 134/98.1; 134/166 C; 134/169 R; 134/171; 134/95.2; 134/169 A

(58) Field of Search ..... 134/99.1, 103.1, 134/169 R, 169 A, 171, 95.2, 94.1, 95.1, 95.3, 97.1, 98.1, 166 R, 169 C, 166 C

(56) References Cited

U.S. PATENT DOCUMENTS

| | | | | |
|---|---|---|---|---|
| 2,755,809 A | * | 7/1956 | Mueller | 134/58 R |
| 2,949,282 A | | 8/1960 | Kirkby | |
| 3,094,998 A | | 6/1963 | Gley | |

(List continued on next page.)

FOREIGN PATENT DOCUMENTS

| | | |
|---|---|---|
| EP | 0042591 A1 | 12/1981 |
| EP | 0175262 | 3/1986 |
| EP | 0467030 | 1/1992 |
| EP | 0815960 | 1/1998 |
| EP | 0509739 A2 | 10/2002 |
| GB | 2200442 A | 8/1988 |
| GB | 2261364 | 5/1993 |
| GB | 2339877 A | 2/2000 |

OTHER PUBLICATIONS

Email from Ms. Crowe to Mr. Moore dated Jul. 31, 2003.

Email to Ms. Crowe from Mr. Moore dated Aug. 11, 2003.

"A Novel Method and Apparatus for Cleaning Oxygen Service Equipment via a Surfactant–Enhanced Fluorocarbon Solvent", by Crowe, Christy L., pp. i to vii.

"Krytox performance lubricants", comprises 5 pages obtained at the web site www.dupont.com on Feb. 13, 2000.

"3M HFEs (Hydrofluoroethers) For Aircraft Cleaning", comprises 6 pages that were obtained at the web site www.3m.com on Mar. 12, 2000.

"Still looking for a fluid you can live with?", comprises 24 pages that were obtained at the web site www.3m.com on Mar. 12, 2000.

WPI Abstract Accession No. 1994–298877/37 discloses an abstract of Japanese Application No. JP6226005A on a "Solvent Composition for Removing Surface Water".

WPI Abstract Accession No. 1983–809601/45 discloses European Patent Application No. 0093046A1 on a "Device for Testing Leaks and Cleaning Conduits by Circulation of a Fluid".

*Primary Examiner*—Frankie L. Stinson
(74) *Attorney, Agent, or Firm*—Bacon & Thomas, PLLC

(57) ABSTRACT

The present invention is an apparatus that cleans contaminants from pipes. The apparatus comprises a high velocity pump, a cleaning solution tank, a first line that selectively connects said cleaning solution tank to said high velocity pump, a solvent tank, a second line that selectively connects said solvent tank to said high velocity pump, a manifold, and a third line that selectively connects said manifold to said high velocity pump.

20 Claims, 1 Drawing Sheet

U.S. PATENT DOCUMENTS 3,435,834 A * 4/1969 Cooper ..... 134/98.1
3,570,503 A * 3/1971 DeBoliac ..... 134/58 R
3,833,417 A * 9/1974 Griparis ..... 134/22.12
3,873,004 A * 3/1975 Feild ..... 222/135
4,299,244 A * 11/1981 Hirai ..... 134/102.1
4,587,032 A 5/1986 Rogers
4,619,709 A 10/1986 Fiocco
4,711,256 A 12/1987 Kaiser
5,039,349 A 8/1991 Schoeppel
5,197,499 A * 3/1993 Bodenmiller et al. ..... 134/95.2
5,288,422 A 2/1994 Basu et al.
5,289,838 A 3/1994 Odell
5,298,083 A 3/1994 Van Der Puy et al.
5,322,571 A * 6/1994 Plummer et al. ..... 134/22.12
5,339,845 A * 8/1994 Huddas ..... 134/169 A
5,350,458 A 9/1994 Pinsl-Ober et al.
5,397,398 A 3/1995 Van Vlahakis et al.
5,440,824 A 8/1995 Ramachandran et al.
5,505,218 A * 4/1996 Steinhauser et al. ..... 134/95.1
5,514,301 A 5/1996 Bil et al.
5,520,837 A 5/1996 Antin et al.
5,603,826 A * 2/1997 Welch ..... 210/195.1
5,660,201 A * 8/1997 Turner ..... 137/240
5,858,114 A * 1/1999 Board et al. ..... 134/18
6,048,832 A 4/2000 Thenappan et al.
6,089,242 A * 7/2000 Buck ..... 134/57 R
6,110,885 A 8/2000 Chan
6,458,214 B1 * 10/2002 Kanda et al. ..... 134/21
6,523,556 B2 * 2/2003 Abad et al. ..... 134/166 C
2001/0045219 A1 11/2001 Fillipi et al.

* cited by examiner

APPARATUS FOR CLEANING PIPES

This application is a divisional of U.S. application Ser. No. 09/828,952, filed Apr. 10, 2001, now U.S. Pat. No. 6,450,182 granted Sep. 17, 2002, and claims the priority under 35 U.S.C. § 119(e) of U.S. Application No. 60/196,296, filed Apr. 12, 2000.

FIELD OF THE INVENTION

This invention relates to the field of cleaning the surfaces within pipes. The surfaces may be metal, including stainless steel. The restricted points of entry may prevent these surfaces from being cleaned by application of mechanical force or sonic energy. The contaminants to be cleaned from the surfaces include organic matter and particulates.

BACKGROUND OF THE INVENTION

The oxygen supply systems on aircraft may comprise oxygen converters, oxygen regulators, molecular sieve oxygen generators (MSOG units), oxygen pipes which are more commonly referred to as oxygen lines, and other apparatus. The cleaning of these oxygen supply systems is required primarily to remove two types of contamination. The first type of contamination arises from organic compounds. These organic compounds include jet fuel, compounds that result from the incomplete combustion of jet fuel, hydraulic oil and special types of greases that are used in these oxygen systems. The second type of contamination arises from particles of dust and dirt, as well as particles of Teflon that are found in the greases that may be used in these oxygen systems, and from Teflon tape which may be used in the threaded connections of these oxygen systems. The particulates may be in a size range of about one to 300 microns, and more commonly, in a size range of about 2 to about 150 microns.

The prior art attempts to clean oxygen lines have involved the use of chlorofluorocarbons, and have generally had unsatisfactory results. Aqueous solvents are unsatisfactory because they are difficult to remove completely and residual water may freeze and create a dangerous buildup of pressure.

There are certain requirements for methods, compositions and apparatus for cleaning the surfaces within aircraft oxygen lines to remove such contaminants. The methods should be able to be carried out in a relatively short period of time. Preferably, the cleaning should be carried out with the minimum removal of components of the oxygen system from the aircraft. The cleaning compositions should be non-aqueous, non-flammable, non-toxic, and environmentally friendly. The solvent of the cleaning compositions should be able to be used as a verification fluid that is circulated through the cleaned components in order to verify cleaning. The apparatus for cleaning should preferably be transportable to the location of the aircraft. The cleaning should achieve at least a level B of ASTM standard G93-96, which may be stated as less than 3 mg/ft$^2$ (11 mg/m$^2$), or less than about 3 mg. of contaminants per square foot of interior surface of the components, or less than about 11 mg. of contaminants per square meter of interior surface of the components. The method of ASTM standard G93-96 may not accurately determine the level of cleanliness in vessels with restricted entry.

There are other installations where clean oxygen lines are required. These include hospitals and physical science research facilities.

SUMMARY OF THE INVENTION

The present invention comprises methods, compositions and apparatus for cleaning the interior surfaces of pipes, and particularly, oxygen lines. These methods, compositions and apparatus have certain features in common, and other features that may be varied depending on the nature of the surfaces to be cleaned.

The present invention achieves the satisfactory cleaning of contaminants from pipes by first pulling a vacuum on the pipe to be cleaned. The pipe is then filled with a solvent, which is preferably a fluorocarbon solvent. After the pipe is filled with solvent, a cleaning solution is pumped at a high velocity through the pipe. The cleaning solution preferably comprises the fluorocarbon solvent, and a fluorosurfactant. The pipe is then rinsed with solvent. A particle counter is used to determine whether the solvent rinse contains an acceptably low number of particles. The solvent is then blown out of the pipe by a gas, such as dry air. A vacuum is then pulled on the pipe to evaporate the solvent. Subsequently, a hot dry gas is pumped through the pipe to remove any remaining solvent. The gas is preferably hot, dry air. The gas exiting from the pipe is then checked with a halogen detector to confirm that it contains an acceptably low level of solvent vapor.

DETAILED DESCRIPTION OF THE INVENTION

Figure 1:
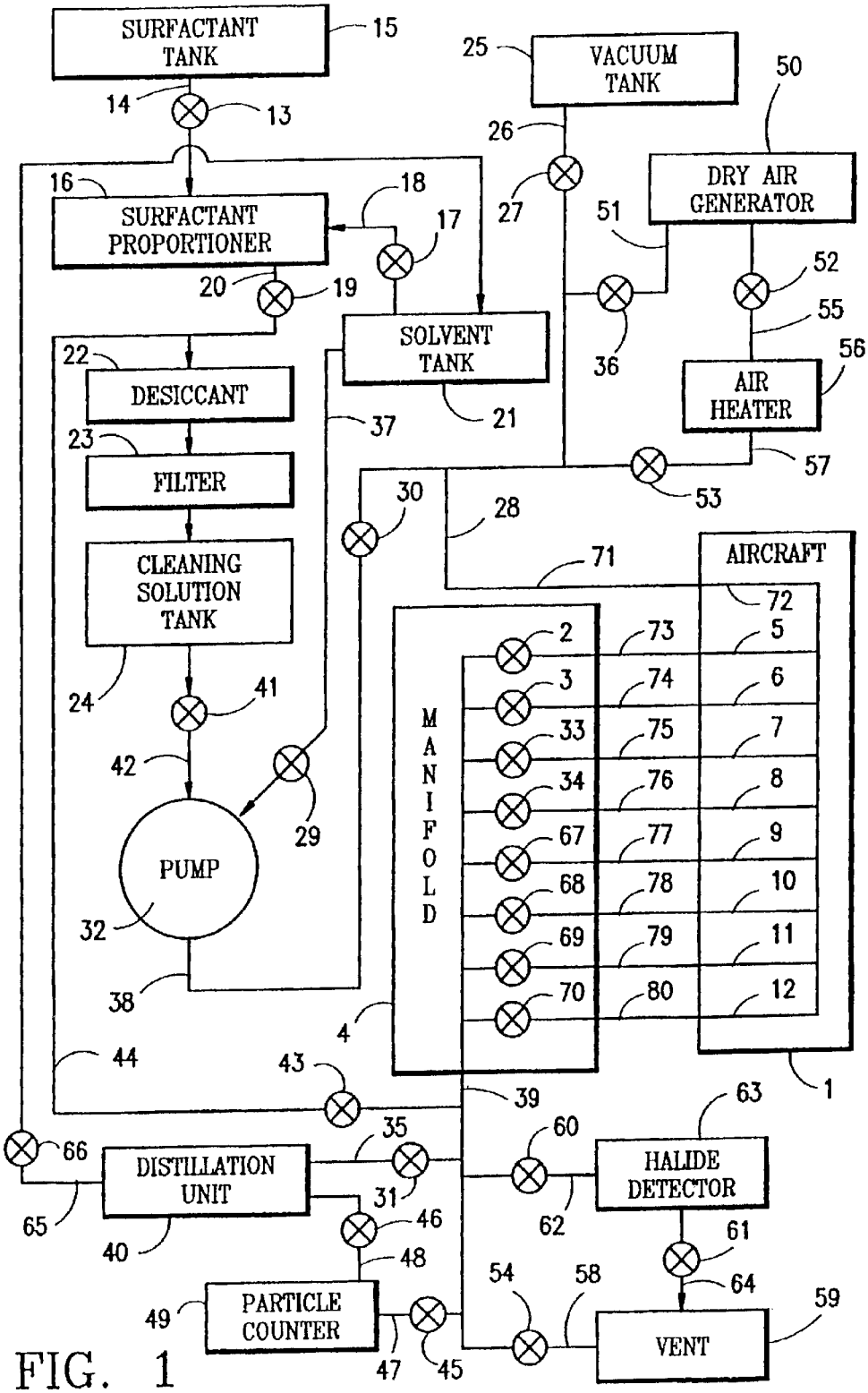
FIG. 1 is a schematic illustration of apparatus embodying the invention.

The solvent may be selected from a number of fluorocarbons. A preferred solvent is HFE301 which is a hydrofluoroether available from 3M, and which comprises methyl heptafluoropropyl ether ($C_3F_7OCH_3$). A more preferred solvent is HFE-7100, which is a mixture of methyl nonafluorobutyl ether, Chemical Abstracts Service No. 163702-08-7, and methyl nonafluoroisobutyl ether, Chemical Abstract Service No. 163702-07-06. HFE-7100 generally comprises about 30–50 percent of methyl nonafluorobutyl ether and about 50–70 percent of the methyl nonafluoroisobutyl ether. A third solvent is FC-72, which is Chemical Abstract Service No. 865-42-1, and comprises a mixture of fluorinated compounds with six carbons. A fourth solvent is FC-77 which is Chemical Abstract Service No. 86508-42-1, and comprises a mixture of perfluorocompounds with 8 carbons. A preferred group of solvents comprises segregated ethers which comprise a hydrocarbon group on one side of the ether oxygen (—O—) and a fluorocarbon group on the other side.

The surfactant of the present invention may be selected from the following fluorosurfactants, or similar fluorosurfactants. The preferred surfactant is L11412 which is available from 3M, and which is a perfluorocarbon alcohol, 100% volatile, and a clear, colorless liquid, with a boiling point in the range of from about 80° C. to about 90° C. and a specific gravity of about 1.8 g./ml. A second surfactant is Krytox alcohol, which is a nonionic fluorosurfactant that comprises hexafluoropropylene oxide homopolymer. A third surfactant is Zonyl UR, which is an anionic flurosurfactant. It comprises Telomer B phosphate, which is known by Chemical Abstracts Service No. 6550-61-2. A fourth surfactant is Krytox 157FS, which is a perfluoropolyether carboxylic acid, Chemical Abstracts Service No. 51798-33-5-100.

A preferred cleaning composition comprises from about 0.001% to about 5% by weight surfactant, and more preferably from about 0.05% to about 0.5% by weight surfactant. In a preferred embodiment, there is about 0.05% by weight of the surfactant in the cleaning composition of the present invention.

The methods and apparatus of the present invention are more fully disclosed in FIG. 1 and the following description.

The apparatus of the present invention is preferably housed in a trailer or other vehicle which is parked adjacent the aircraft. An aircraft may have one or more oxygen lines. In some aircraft, there is one oxygen line for each oxygen mask that is worn by a crew member. Each aircraft oxygen line may be provided with an oxygen regulator. In practicing the invention, the oxygen regulator is typically removed from each aircraft oxygen line before it is connected to the apparatus of the present invention.

In FIG. 1, aircraft 1 is shown comprising eight oxygen lines 5, 6, 7, 8, 9, 10, 11 and 12. The apparatus of the present invention comprises hose 71 which is adapted to be attached to line 72 which is the main terminus of all of the oxygen lines. Manifold 4 is provided with hoses 73, 74, 75, 76, 77, 78, 79 and 80, which are adapted to be attached to the terminus of oxygen lines 5, 6, 7, 8, 9, 10, 11 and 12, respectively. Manifold 4 is provided with valves 2, 3, 33, 34, 67, 68, 69 and 70 to allow selective communication between oxygen lines 5, 6, 7, 8, 9, 10, 11 and 12, respectively, on the one hand, and line 39 on the other hand.

In a method according to the present invention, valve 13 in line 14 is opened. This allows concentrated surfactant from surfactant tank 15 to flow through line 14 to surfactant proportioner 16. The concentrated surfactant may be from about 8% to about 15% by weight of the solvent. After surfactant proportioner 16 is filled with a fixed volume of concentrated surfactant, valve 13 is closed. Valve 17 in line 18 is opened, and valve 19 in line 20 is opened. A fixed volume of solvent from solvent tank 21 is pumped by a pump (not shown) through line 18 to surfactant proportioner 16. The fixed volume of concentrated surfactant from surfactant proportioner 16 and the fixed volume of solvent from solvent tank 21, flow through line 20, through desiccant 22, through filter 23 and into cleaning solution tank 24. Valves 17 and 19 are closed. The foregoing steps may be repeated until a predetermined amount of cleaning solution is present in cleaning solution tank 24.

Vacuum pump 25 is turned on and evacuates line 26. Hoses 71, 73, 74, 75, 76, 77, 78, 79 and 80 are attached to aircraft oxygen lines 72, 5, 6, 7, 8, 9, 10, 11 and 12, respectively. Valve 27 is opened, while valves 2, 3, 33, 34, 67, 68, 69 and 70 are closed. Vacuum pump 25 is used to leak test aircraft oxygen lines 72, 5, 6, 7, 8, 9, 10, 11 and 12 through hose 71 and lines 28 and 26. After a predetermined level of evacuation is achieved, valve 27 is closed. Vacuum pump 25 may be turned off. Valves 2, 3, 29, 30, 31, 33, 34, 67, 68, 69 and 70 are opened. Pump 32 is turned on. Solvent is pumped from solvent tank 21 through line 37, through pump 32, through lines 38 and 28, through hose 71, through aircraft oxygen lines 72 and 5, 6, 7, 8, 9, 10, 11 and 12, through hoses 73, 74, 75, 76, 77, 78, 79 and 80, and through lines 39 and 35 to distillation unit 40. After aircraft oxygen lines 72, 5, 6, 7, 8, 9, 10, 11 and 12 are full of solvent, valves 3, 29, 31, 33, 34, 67, 68, 69 and 70 are closed, and valves 41 and 43 are opened.

Cleaning solution is pumped by pump 32 from cleaning solution tank 24, through line 42, through pump 32, through lines 38 and 28, through hose 71, through aircraft oxygen lines 72 and 5, through hose 73, through lines 39 and 44, through desiccant 22, through filter 23 and into cleaning solution tank 24. Filter 23 should remove a substantial amount of particles. The cleaning solution is pumped by pump 32 through this continuous loop for a predetermined amount of time at a relatively high velocity. The velocity through aircraft oxygen lines 72 and 5 is preferably from about 10 to about 30 feet (about 3.0 to 9.1 meters) per second, and more preferably from about 16 to about 25 feet (about 4.9 to 7.6 meters) per second. After the cleaning solution has been pumped through this loop for a predetermined amount of time, valve 3 is opened and valve 2 is closed. After the cleaning solution has been pumped through this loop for a predetermined amount of time, valve 33 is opened and valve 3 is closed. After the cleaning solution has been pumped through this loop for a predetermined amount of time, valve 34 is opened and valve 33 is closed. After the cleaning solution has been pumped through this loop for a predetermined amount of time, valve 67 is opened and valve 34 is closed. After the cleaning solution has been pumped through this loop for a predetermined amount of time, valve 68 is opened and valve 67 is closed. After the cleaning solution has been pumped through this loop for a predetermined amount of time, valve 69 is opened and valve 68 is closed. After the cleaning solution has been pumped through this loop for a predetermined amount of time, valve 70 is opened and valve 69 is closed. After the cleaning solution has been pumped through this loop for a predetermined amount of time, valves 41 and 43 are closed, and valves 2, 3, 29, 31, 33, 34, 67, 68, 69 and 70 are opened.

Solvent is pumped by pump 32 from solvent tank 21, through line 37, through pump 32, through lines 38 and 28, through hose 71, through aircraft oxygen lines 72, 5, 6, 7, 8, 9, 10, 11 and 12, through hoses 73, 74, 75, 76, 77, 78, 79 and 80, through manifold 4, and through lines 39 and 35 to distillation unit 40. The velocity of the solvent does not have to be a relatively high velocity. After aircraft oxygen lines 72, 5, 6, 7, 8, 9, 10, 11 and 12 have been rinsed with solvent, valves 45 and 46 are opened. Pump 32 continues to pump solvent from solvent tank 21, through line 37, through pump 32, through lines 38 and 28, through hose 71, through aircraft oxygen lines 72, 5, 6, 7, 8, 9, 10, 11 and 12, through hoses 73, 74, 75, 76, 77, 78, 79 and 80, to manifold 4. Solvent is further pumped from manifold 4 through lines 39 and 47, through particle counter 49, and through lines 48 and 35 to distillation unit 40. If the amount of particles in the solvent passing through particle counter 49 is below a predetermined level, then aircraft oxygen lines 72, 5, 6, 7, 8, 9, 10, 11 and 12 have been cleaned. On the other hand, if the amount of particles in the solvent passing through particle counter 49 is not low enough to meet a predetermined level, then the steps of pumping cleaning solution through aircraft oxygen lines 72, 5, 6, 7, 8, 9, 10, 11 and 12 may be repeated.

When aircraft oxygen lines 72, 5, 6, 7, 8, 9, 10, 11 and 12 have been cleaned, pump 32 is turned off, valves 29, 30, 45 and 46 are closed, and valves 31 and 36 are opened. Dry air from dry air generator 50 is forced by a pump or other means (not shown) through lines 51 and 28, and through hose 71 to aircraft oxygen line 72. This forces the remaining solvent out of aircraft oxygen lines 72, 5, 6, 7, 8, 9, 10, 11 and 12, through hoses 73, 74, 75, 76, 77, 78, 79 and 80, through manifold 4, and through lines 39 and 35 to distillation unit 40. After the remaining solvent has been forced out of aircraft oxygen lines 72, 5, 6, 7, 8, 9, 10, 11 and 12, valves 2, 3, 31, 33, 34, 36, 67, 68, 69 and 70 are closed. Valve 27 is opened. Vacuum pump 25 pulls a vacuum through lines 26 and 28 and through hose 71, on aircraft oxygen lines 72, 5, 6, 7, 8, 9, 10, 11 and 12. After a predetermined level of evacuation has been achieved, valve 27 is closed, and valves 2, 3, 33, 34, 67, 68, 69, 70, 52, 53, and 54 are opened.

Dry air from dry air generator 50 is forced by a pump or other means (not shown) through line 55 to air heater 56. Air heater 56 is turned on. Air heater 56 heats the dry air which is further forced through lines 57 and 28, through hose 71, through aircraft oxygen lines 72, 5, 6, 7, 8, 9, 10, 11 and 12, through hoses 73, 74, 75, 76, 77, 78, 79 and 80, through manifold 4, and through lines 39 and 58 to vent 59. After a predetermined amount of heated dry air has been forced through aircraft oxygen lines 72, 5, 6, 7, 8, 9, 10, 11 and 12, valves 60 and 61 are opened. The heated dry air exiting from manifold 4 passes through lines 39 and 62, through halide detector 63, and through lines 64 and 58 to vent 59. If the amount of halide detected by halide detector 63 is below a predetermined level, then aircraft oxygen lines 72, 5, 6, 7, 8, 9, 10, 11 and 12 have been dried. On the other hand, if the level of halide that is detected by halide detector 63 is above a predetermined level, then additional hot dry air may be forced through aircraft oxygen lines 72, 5, 6, 7, 8, 9, 10, 11 and 12, until the level of halide is below the predetermined level.

After the level of halide that is detected by halide detector 63 is below the predetermined level, air heater 56 is turned off and valves 2, 3, 33, 34, 52, 53, 60, 61, 67, 68, 69 and 70 are closed. Hoses 71, 73, 74, 75, 76, 77, 78, 79 and 80, may now be disconnected from aircraft oxygen lines 72, 5, 6, 7, 8, 9, 10, 11 and 12, respectively.

Solvent may be recycled before, during or after the steps that are described above, by opening valve 66 and activating distillation unit 40. The solution within distillation unit 40 is heated to vaporize the solvent, and the condensed solvent vapor is gravity fed through line 65 to solvent tank 21.

Variations of the invention may be envisioned by those skilled in the art.

What is claimed is:

1. An apparatus for cleaning pipes comprising a high velocity pump, a cleaning solution tank, a first line that selectively connects said cleaning solution tank to said high velocity pump, a solvent tank, a second line that selectively connects said solvent tank to said high velocity pump, a manifold, a third line that selectively connects said manifold to said cleaning solution tank, a first hose which is adapted to be attached to a first pipe to be cleaned, a fourth line that selectively connects said first hose to said high velocity pump, wherein said apparatus is adapted to pump a cleaning solution from said cleaning solution tank, through said first line, through said high velocity pump, through said fourth line, through said first hose, through said pipe to be cleaned, and through said third line to said cleaning solution tank.

2. The apparatus as claimed in claim 1, wherein said first pipe to be cleaned is an oxygen line of an aircraft, and further comprising a dry air generator that is selectively connected to said first hose.

3. The apparatus as claimed in claim 2, further comprising a vacuum pump that is selectively connected to said first hose, and an air heater that is selectively connected to both said dry air generator and said first hose.

4. The apparatus as claimed in claim 1, further comprising a halide detector that is selectively connected to said manifold.

5. The apparatus as claimed in claim 4, further comprising a first hose which is adapted to be attached to a main terminus of all of the oxygen lines of an aircraft, a fourth line that selectively connects said first hose to said high velocity pump, a dry air generator that is selectively connected to said first hose, a vacuum pump that is selectively connected to said first hose, and an air heater that is selectively connected to both said dry air generator and said first hose, wherein said manifold is adapted to be attached to the terminus of one or more oxygen lines of said aircraft.

6. The apparatus as claimed in claim 5, further comprising a particle counter that is selectively connected to said manifold, wherein said particle counter is adapted to count particulates in a size range of about one to 300 microns.

7. The apparatus as claimed in claim 6, wherein said high velocity pump is adapted to pump at a velocity from about 10 to about 30 feet per second.

8. The apparatus as claimed in claim 7, wherein said particle counter is adapted to count particulates in a size range of about 2 to about 150 microns, and wherein said high velocity pump is adapted to pump at a velocity from about 16 to about 25 feet per second.

9. The apparatus as claimed in claim 8, further comprising a filter in said third line.

10. An apparatus for cleaning pipes comprising a high velocity pump, a cleaning solution tank, a first line that selectively connects said cleaning solution tank to said high velocity pump, a solvent tank, a second line that selectively connects said solvent tank to said high velocity pump, a manifold, a third line that selectively connects said manifold to said cleaning solution tank, a halide detector that is selectively connected to said manifold, a first hose which is adapted to be attached to a main terminus of all of the oxygen lines of an aircraft, a fourth line that selectively connects said first hose to said high velocity pump, a dry air generator that is selectively connected to said first hose, a vacuum pump that is selectively connected to said first hose, an air heater that is selectively connected to both said dry air generator and said first hose, and a particle counter that is selectively connected to said manifold, wherein said manifold is adapted to be attached to the terminus of one or more oxygen lines of said aircraft, said particle counter is adapted to count particulates in a size range of about 2 to about 150 microns, and said high velocity pump is adapted to pump at a velocity from about 16 to about 25 feet per second.

11. The apparatus as claimed in claim 10, further comprising a filter in said third line.

12. An apparatus for cleaning pipes comprising:

a pump;

a cleaning solution tank;

a first line that selectively connects said cleaning solution tank to said pump;

a solvent tank;

a second line that selectively connects said solvent tank to said pump;

a manifold connectable to said pipes;

a third line that selectively connects said manifold to said cleaning solution tank;

a vacuum device connectable to said pipes and adapted to leak test said pipes;

said pump is adapted to pump solvent from said solvent tank into said pipes;

a filter device connected to said cleaning solution tank;

said pump is adapted to pump cleaning solution from said cleaning solution tank into said pipes filled with said solvent at a high velocity; and said pump is adapted to pump additional amounts of said solvent into said pipes to flush out said cleaning solution from said pipes.

13. The apparatus as claimed in claim 12, wherein the filter device further comprises a desiccant.

14. The apparatus as claimed in claim 12, further comprising a particle counter adapted to determine acceptable levels of particles in said solvent after said cleaning solution is flushed by additional amounts of said solvent.

15. The apparatus as claimed in claim 14, further comprising an air source connectable to said pipes, said air source forces air through said pipes to remove liquid in said pipes after said particle counter determines that the level of particles in said pipes is acceptable.

16. The apparatus as claimed in claim 15, further comprising an air heater that heats air entering said pipes from said heat source.

17. The apparatus as claimed in claim 16, wherein said vacuum device is adapted to evaporate any of said solvent in said pipes after heated air is forced through said pipes.

18. The apparatus as claimed in claim 15, further comprising a halide detector connectable to said pipes, said halide detector determines acceptable levels of solvent vapor that may be present in said pipes after air from said air source is forced through said pipes.

19. The apparatus as claimed in claim 15, further comprising a distillation unit that distills said solvent flushed through the apparatus so that said solvent can be reused.

20. The apparatus as claimed in claim 12, wherein said cleaning solution is pumped into said pipes at about 10 to 30 feet per second.

* * * * *